US006629611B2

(12) United States Patent
Satake et al.

(10) Patent No.: US 6,629,611 B2
(45) Date of Patent: Oct. 7, 2003

(54) GRANULAR OBJECT SORTING APPARATUS

(75) Inventors: Satoru Satake, deceased, late of Tokyo (JP), by Toshiko Satake, legal representative; Takeshi Fukumori, Tokyo (JP)

(73) Assignee: Satake Corporation (JP)

( * ) Notice: Subject to any disclaimer, the term of this patent is extended or adjusted under 35 U.S.C. 154(b) by 0 days.

(21) Appl. No.: 09/882,635

(22) Filed: Jun. 14, 2001

(65) Prior Publication Data

US 2002/0008056 A1 Jan. 24, 2002

(30) Foreign Application Priority Data

Jun. 16, 2000 (JP) ..... 2000/182203

(51) Int. Cl.[7] ..... B07C 5/342

(52) U.S. Cl. ..... 209/657; 209/653; 209/582; 209/908; 198/439

(58) Field of Search ..... 209/638, 640, 209/653, 657, 562, 563, 908, 939, 576, 577, 580, 581, 582, 587, 588; 198/370.07, 370.02, 597, 439, 370.13

(56) References Cited

U.S. PATENT DOCUMENTS

| | | | | | |
|---|---|---|---|---|---|
| 2,504,731 | A | * | 4/1950 | Rose et al. | 209/439 |
| 2,587,686 | A | * | 3/1952 | Berry | 209/581 |
| 3,738,484 | A | * | 6/1973 | Hoover et al. | 209/581 |
| 3,802,558 | A | * | 4/1974 | Rhys | 209/557 |
| 3,990,581 | A | * | 11/1976 | Tengsater | 209/580 |
| 4,088,227 | A | * | 5/1978 | Lockett | 209/581 |
| 4,099,620 | A | * | 7/1978 | Kendall et al. | 209/587 |
| 4,231,478 | A | * | 11/1980 | Stone | 209/576 |
| 4,236,640 | A | * | 12/1980 | Knight | 208/12 |
| 4,314,645 | A | * | 2/1982 | Perkins et al. | 209/638 |
| 4,319,269 | A | | 3/1982 | Kajiura et al. | |
| 4,520,702 | A | | 6/1985 | Davis et al. | |
| 4,576,482 | A | | 3/1986 | Pryor | |
| 4,581,632 | A | | 4/1986 | Davis et al. | |
| 4,738,175 | A | | 4/1988 | Little et al. | |
| 4,829,380 | A | | 5/1989 | Iadipaolo | |
| 4,853,533 | A | | 8/1989 | Little et al. | |
| 4,906,099 | A | | 3/1990 | Casasent | |
| 5,060,290 | A | | 10/1991 | Kelly et al. | |
| 5,090,574 | A | * | 2/1992 | Hamby | 198/360 |
| 5,119,205 | A | | 6/1992 | Lemelson | |
| 5,151,822 | A | | 9/1992 | Hekker et al. | |
| 5,197,607 | A | * | 3/1993 | Hakansson | 198/434 |
| 5,283,641 | A | | 2/1994 | Lemelson | |
| 5,318,173 | A | | 6/1994 | Datari | |
| 5,335,293 | A | | 8/1994 | Vannelli et al. | |
| 5,487,472 | A | * | 1/1996 | Satake et al. | 209/581 |
| 5,509,537 | A | * | 4/1996 | Crismon et al. | 198/367 |
| 5,526,437 | A | | 6/1996 | West | |
| 5,659,624 | A | | 8/1997 | Fazzari et al. | |
| 6,100,488 | A | * | 8/2000 | Satake et al. | 209/580 |

FOREIGN PATENT DOCUMENTS

| | | | | |
|---|---|---|---|---|
| JP | 402204213 | * | 8/1990 | 198/370.07 |
| JP | 09-113454 | | 5/1997 | |
| JP | P2001-179187 A | | 7/2001 | |

* cited by examiner

*Primary Examiner*—Donald P Walsh
*Assistant Examiner*—Daniel K Schlak
(74) *Attorney, Agent, or Firm*—Wells St. John P.S.

(57) ABSTRACT

A reciprocating rod of the ejector is borne in a non-sliding state by permanent magnets on the reciprocating rod and permanent magnets surrounding the reciprocating rod. The reciprocating rod linearly projects out and retracts by the reciprocating components which cause the reciprocating rod to reciprocate by the driving signals from the driver circuit. A slanted surface is provided at the foremost end of the reciprocating rod. When the granular objects to be ejected flow-in continuously, the projecting-out action takes place correspondingly with the leading granular object to be ejected and, after the following granular object(s) to be ejected has been ejected, the retracting action takes place.

5 Claims, 10 Drawing Sheets

VERTICALLY CONTRACTING PROCESS

HORIZONTALLY CONTRACTING PROCESS

COLORED GRAIN

ENLARGING PROCESS

1 DIVISION
(WIDTH OF 1 NOZZLE)

CENTER DETECTION

1 BLOCK

CENTER DETECTION

CENTER PORTION DETERMINATION

GRANULAR OBJECT SORTING APPARATUS

RELATED APPLICATIONS

This application relates to and claims priority to corresponding Japanese Patent Application No. 182203/2000 filed on Jun. 16, 2000.

BACKGROUND OF THE INVENTION

1. Field of the Invention

The present invention relates to a granular object sorting apparatus for sorting out a particular granular object wherein diffusion light from granular objects of raw materials to be sorted is received and each object is subjected to the determination as to whether it is acceptable or unacceptable based on the received diffusion light. More specifically, the present invention relates to an ejection means used in such sorting apparatus.

2. Description of the Related Art

Japanese Patent Application Kokai-Publication No. Hei 9-113454 discloses an ejection means for a grain sorting apparatus, which is constructed by a plate spring means arranged at a point downstream of a point where the grains are image-taken by a CCD camera and divided into a plurality of plate sections along a transverse direction with respect to the falling locus of the grains; a plurality of solenoid means for deforming corresponding plate sections of the plate spring means; and a solenoid control means for selectively supplying driving power to the solenoid means. The falling locus of the grain is changed by the deviation of the corresponding plate section of the plate spring means and by the direct hitting thereof against the grains in such divided plate sections whereby sorting out of the unacceptable ones from the acceptable ones is performed.

As compared to the conventional ejecting means in which an ejector nozzle for outputting jet air is provided, the above explained ejecting means is very advantageous in term of cost because it does not need the air source. Further, because it does not need the air conduits which have conventionally crossed with the electric wirings, its inner construction structured mainly by the electric wirings is very simple. In addition, as the maintenance is necessary only for the electric wirings, it can be said that the total maintenance required is reduced to half.

However, since the solenoid has such a construction that either one of the retracting or projecting-out operation of the reciprocating rod thereof is dependent on such a resilient member as a coil spring, there is a limit in response performance of the retracting and projecting-out operation of the reciprocating rod. For this reason, in the case where such solenoid is used as an ejecting means, there is an inevitable limit in the sorting performance.

In this connection, the applicant of the present application filed a patent application (Patent Application No. Hei 11-365740) for a granular object sorting apparatus in which the solenoid having the improved response performance of the retracting or projecting-out operation over the conventional solenoids is used as a sorting means. Such solenoid is configured such that the reciprocating rod is provided with permanent magnets and with a further permanent magnets which surround the reciprocating rod so as to bear the reciprocating rod in a non-sliding state or a floating state and, by the ON/OFF action of the reciprocating means configured by the permanent magnets on the reciprocating rod and the electromagnetic coils surrounding the reciprocating rod, the retracting or the projecting-out operation of the reciprocating rod is caused. Since, in this way, the reciprocating rod is borne in the non-sliding state, the response performance of the retracting and projecting-out operation of the reciprocating rod has been improved over that of the conventionally available solenoid. Unacceptable granular objects are ejected or sorted out at the tip portion of the reciprocating rod of the solenoid.

However, in the case where the granular objects to be ejected by a given solenoid (ejection means) flow continuously, there was a concern that such granular objects may not be ejected merely by improving the response performance of the retracting and projecting-out operation of the reciprocating rod. The problem resides in the space in which the granular objects continuously flow. Between the contiguous granular objects, there can be a space which allows the ejection of both the granular objects by the response of the reciprocating rod of the solenoid and there can also be a space which does not allow the ejection by such response of the reciprocating rod. In the latter case, even though the first granular object could have been ejected, the second granular object could not be ejected because the projecting-out operation of the reciprocating rod is not made in time so that such unacceptable granular object of the second one flows through together with the acceptable granular objects.

Therefore, an object of the present invention is to provide a granular object sorting apparatus in which, even when the granular objects to be ejected by a given ejection means flow-in continuously, these granular objects are appropriately ejected thereby improving and enhancing a sorting precision over that in the conventional apparatuses.

SUMMARY OF THE INVENTION

In order to solve the above problems, the present invention provides a granular object sorting apparatus in which, at a point along a falling locus of the granular object released from a transfer means which transfers granular objects to be sorted, there are provided an illuminating means for irradiating light to the granular object; a light receiving means for receiving light from the granular object having received irradiating light of the illuminating means; and an ejection means for ejecting the granular object to be ejected; and in which there are provided a determination means for determining the granular objects to be ejected based on a received light signal from the light receiving means; and a driver circuit for outputting a driving signal to the ejection means based on an ejection signal from the determination means, said ejection means being provided with a reciprocating rod which is borne in a non-sliding state and which linearly projects out or retracts in an axial direction; and a reciprocating means for causing the reciprocating rod to retract or project out by the driving signal from the driver circuit and, at the tip portion of the reciprocating rod, there is provided a slanted surface inclining towards the projecting-out direction of the reciprocating rod from the upstream side of the falling locus, with the slanted surface hitting the granular object in the falling locus during the projecting-out operation of the reciprocating rod; and it is arranged that the driver circuit outputs a driving signal to the reciprocating means so that, when the granular objects to be ejected by a given ejection means are determined as contiguous, the retracting or projecting-out operation of the reciprocating rod is caused correspondingly in such a manner that the reciprocating rod is projected out according to the first (leading) granular object to be ejected and, after the ejection of all the second or succeeding granular object(s) to be ejected, the retracting operation takes place.

The ejection means which effects the ejection of the falling granular objects by the reciprocating rod is configured such that the reciprocating rod is in a non-sliding state so that there is no possibility for the reciprocating rod to be subjected to any load caused by sliding friction in the reciprocating rod during the retracting or projecting-out operation thereof. Further, since the granular objects to be ejected are directly removed by the reciprocating rod, it is sufficient that the ejection means has only a pressing power to eject the granular object. Therefore, as compared to the conventional ejection means, it is possible to make the ejection means of the invention compact, which requires a small driving power. Still further, since the reciprocating rod is projected out or retracted by the reciprocating means, without depending on such as a coil spring for either one of the projecting-out and retracting operations and also the reciprocating rod is borne in a non-sliding or floating manner, the arrangement can achieve the response performance as good as the conventional air type ejector, thus enabling the maintenance of the same productivity as before and also enabling, with the dispensing of any air source, the provision of an energy-saving granular object sorting apparatus. Further, at the foremost end portion of the reciprocating rod, there is provided a slanted surface inclining towards the projecting-out direction of the reciprocating rod from the upstream side of the falling locus, with the slanted surface hitting the granular object in the falling locus during the projecting-out operation of the reciprocating rod, and it is arranged that the driver circuit outputs a driving signal to the reciprocating means so that, when the granular objects to be ejected by a given ejection means are determined as contiguous, the projecting-out operation of the reciprocating rod is caused correspondingly to the leading granular object to be ejected and, after the ejection of the succeeding granular object or objects to be ejected, the retracting operation takes place. Thus, the leading defective granular object is ejected by the slanted surface of the reciprocating rod which projects out correspondingly to the leading granular object, and the second defective granular object succeeding to the leading granular object is ejected by being hit by the slanted surface of the reciprocating rod held in the projected-out state. The reciprocating rod performs the retracting operation after the ejection of the second granular object. Thus, even when the defective granular objects to be ejected by a given ejection means flow-in continuously, these granular objects are ejected so that the grain sorting precision is improved and enhanced. In addition, since the frequency or number of the projecting-out and retracting operation required to the reciprocating rod decreases as compared to the conventional ones, wear of the ejection means can be made small.

Further, the ejection means is configured such that, by permanent magnets provided on the reciprocating rod and permanent magnets provided to surround the reciprocating rod, the reciprocating rod is borne in a non-sliding state and, by the ON/OFF action of the reciprocating means configured by the permanent magnets on the reciprocating rod and the electromagnetic coils surrounding the reciprocating rod, it is made possible to effect the retracting or projecting-out operation of the reciprocating rod. In this way, by utilizing the repelling action between the permanent magnets on the reciprocating rod and the electromagnetic coils surrounding the reciprocating rod, it is made possible for the bearing of the reciprocating rod to be in a non-sliding state and, by utilizing the repelling action/attracting action of the permanent magnet of the reciprocating rod and the electromagnetic coils surrounding the same, it is made possible for the reciprocating rod to assume the retracting and projecting-out operations. In this way, the retracting and projecting-out operations can be controlled independently by the ejection means itself. Also, since the retracting and projecting-out operations are in a non-sliding state, it is possible for the reciprocating rod to be driven in the extent of 2 ms, which amounts to the same response speed as in a conventional ejector type means in which air is jetted.

Usually, the ejection means is used by placing it in a transverse direction of the flow of the granular objects, with a plurality of the ejection means being positioned in the transverse direction. The plurality of ejection means are preferred to be arranged in a zigzag manner. That is, where the reciprocating rods are arranged in a zigzag manner, even when the area occupied by one reciprocating means is larger than one granular object, the reciprocating rods may be arranged without gaps in the transverse direction. This is because the ejection means of the present invention provides ejecting function independently and does not require a separate member such as a plate spring so that the plurality of ejection means may be arranged in any desired manner.

BRIEF DESCRIPTION OF THE DRAWINGS

The above and other objects, features and advantages of the present invention will be apparent from the following description of preferred embodiments of the invention explained with reference to the accompanying drawings, in which:

FIG. 2(*b*) is a simplified plan view of the injection means of FIG. 2(*a*) positioned in the projecting-out position;

FIG. 2(*c*) is a simplified plan view of the injection means of FIG. 2(*a*) positioned in the retracting position;

PREFERRED EMBODIMENT OF THE INVENTION

Figure 1:
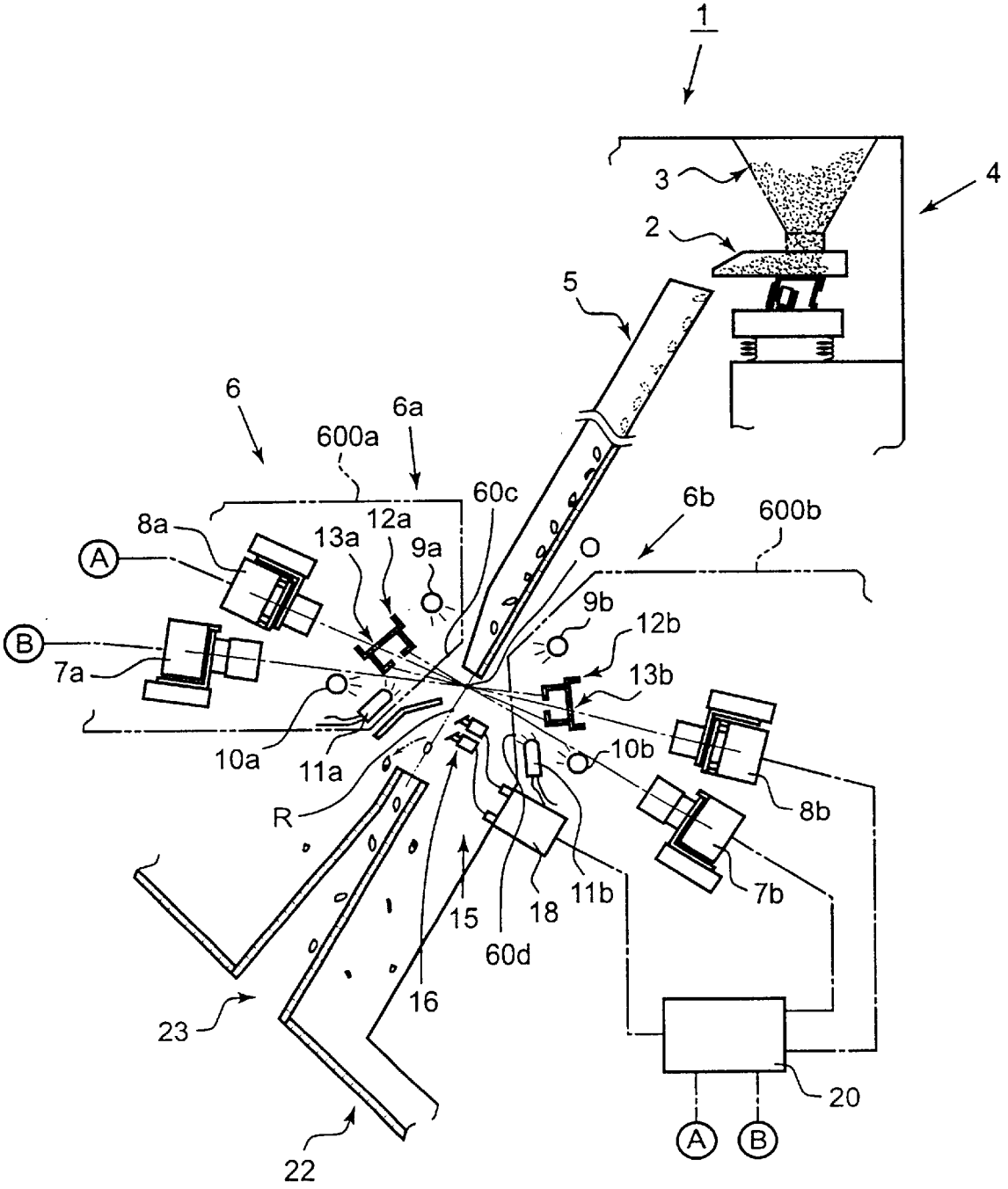
FIG. 1 is a diagrammatic sectional view of the granular object sorting apparatus according to the invention.
Figure 2A:
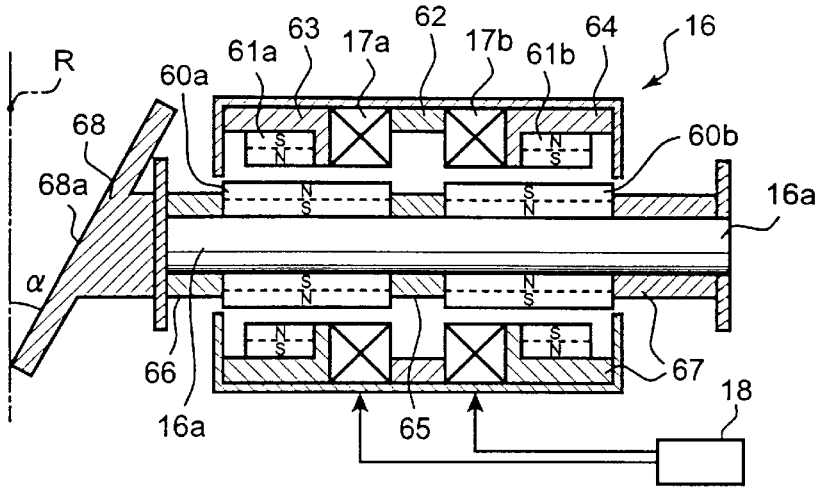
FIG. 2(*a*) is an enlarged longitudinal sectional view of an injection means.
Figure 2B:
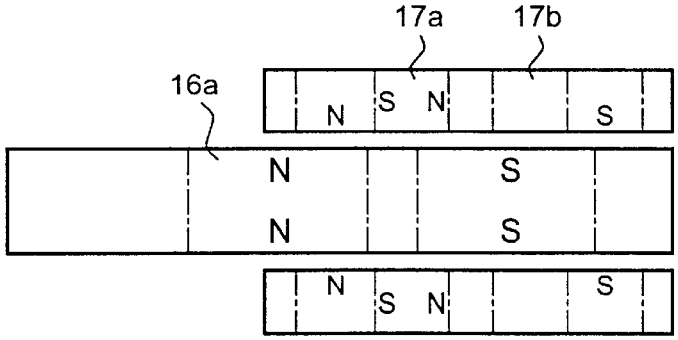
Figure 2C:
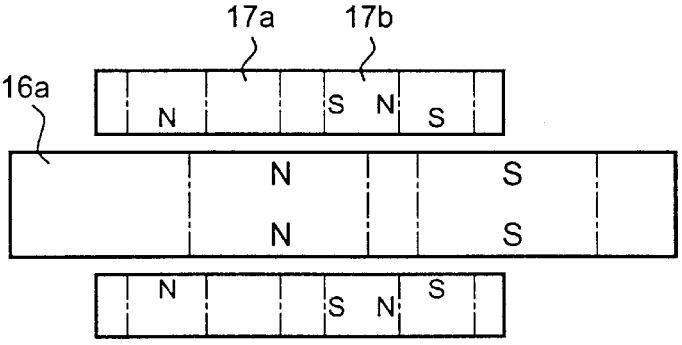

The outline of the granular object sorting apparatus according to the present invention is explained with reference to FIGS. 1 and 2. The sorting apparatus explained herein is one in which, for grains among granular objects, especially rice grains as raw materials to be sorted, the sorting or ejection is made for rice grains having colored portions or foreign objects mixed in the rice grains. FIG. 1 is a sectional view diagrammatically showing main elements and their internal structural arrangement of the granular object sorting apparatus 1. The apparatus is equipped, at its upper portion thereof, with a rice grain supplying section 4 which is formed by a vibration feeder means 2 and a tank section 3, and a chute 5 which is in an inclined plate-like form and transfers to a predetermined falling locus the rice grains supplied from the vibration feeder means 2. The rice grains thus transferred by this chute 5 are then released to an optical detecting section 6 to follow.

The optical detecting section 6 is constituted by a front side optical detection section 6*a* and a rear side optical detection section 6*b* which are arranged substantially symmetrically with the locus R of the rice grains released from the chute 5 being in a center. The front and rear side detection sections 6*a* and 6*b* have frame members 600*a* and 600*b*, respectively, and only the portions at the falling locus R side thereof are formed by transparent plates 60*c* and 60*d*, respectively. Each of the front and rear side optical detection sections 6*a* and 6*b* is provided, at the front and rear with respect to the viewing point 0 set in the falling locus of the rice grains, with a visual light receiving section 7*a*, 7*b* equipped with a CCD sensor having as an image element, for example, a silicon (Si) sensor, and a near infrared light receiving section 8*a*, 8*b* equipped with an analog sensor constituted by an InGaAs element. The visual light receiving section 7*a*, 7*b* and the near infrared light receiving section 8*a*, 8*b* are provided correspondingly to the width direction of the chute 5. There are also provided illuminating fluorescent lamps 9*a*, 9*b* and 10*a*, 10*b*, illuminating halogen lamps 11*a*, 11*b*, and background plates 12*a*, 12*b* corresponding to the respective light receiving sections. In the background plates 12*a*, 12*b*, there are provided openings 13*a*, 13*b* so as not to interrupt the viewing line between the light receiving sections 8*a*, 8*b* and the viewing point 0. The visual light receiving section 7 and the near infrared light receiving section 8 may respectively be configured advantageously by a wide angle camera equipped with a well-known converging lens.

The sorting section 15 is disposed under the optical detecting section 6 along the direction in which the rice grains fall down, and a plurality of ejection means 16 each having a reciprocating rod to retract and project out with respect to the falling locus R of the rice grains are disposed in the direction of the width of the chute 5. Each of the ejection means 16 is provided with electromagnetic coils 17*a* and 17*b* (a part of the reciprocating means) for causing the reciprocating rod 16*a* to retract and project out and permanent magnets 60*a* and 60*b* (a part of the reciprocating means) which are mounted on the reciprocating rod 16*a*. The electromagnetic coils 17*a* and 17*b* are connected to a driver circuit 18 which controls the electromagnetic coils 17*a* and 17*b*.

The light receiving sections 7 and 8 are connected to the driver circuit 18 through a control unit 20 which is explained later, and the signals received from the rice grains or foreign objects through the light receiving sections 7, 8 are processed by the control unit 20. When the defective rice grains having colored portions or the foreign objects are detected, such detection is communicated to the driver circuit or means 18. The driver circuit 18 outputs driving signals (projecting-out signal or retracting signal) for causing the reciprocating rod to project out or retract by changing the power supply to either one of the electromagnetic coils 17*a* and 17*b* of the corresponding ejection means 16. Upon the operation of the driver circuit 18, the defective rice grains or the foreign objects flicked out by the projecting-out operation of the reciprocating rod 16*a* are ejected from the grain falling locus R and are then discharged to the outside of the apparatus through an unacceptable object outlet 22. On the other hand, the acceptable grains, that is, the grains that have not been flicked out, are discharged to the outside from an acceptable object outlet 23 along the rice grain falling locus.

Next, the ejection means 16 is explained with reference to FIG. 2. FIG. 2(*a*) is a longitudinal sectional view of the ejection means 16. On the rod 16*a*, there are mounted two permanent magnets 60*a* (N pole) and 60*b* (S pole) with a predetermined space being provided therebetween in such a manner that the outer pole polarities thereof are different from each other. Two permanent magnets 61*a* (N pole) and 61*b* (S pole) are disposed so as to surround the permanent magnets 60*a* and 60*b*, respectively, in such a manner that there occur repelling forces between the permanent magnets 61*a* and 60*a*, and between the permanent magnets 61*b* and 60*b*, respectively. In this way, the reciprocating rod 16*a* is supported in a floating fashion. Between the permanent magnets 61*a* and 61*b*, there are arranged electromagnetic coils 17*a* and 17*b* which surround the rod 16*a*. The electromagnetic coils 17*a* and 17*b* are connected to the power source in such a way that, when they are supplied with power, the directions of currents flowing therein are opposite with each other. By changing the directions of the power supply currents to the electromagnetic coils 17*a* and 17*b*, and by causing the poles occurring around the respective electromagnetic coils 17*a* and 17*b* to act on the permanent magnets 60*a* and 60*b*, the rod 16*a* performs the retracting and projecting-out operation in the direction of the rod based on the attracting and repelling actions between the poles of the electromagnetic coils 17*a*, 17*b* and those of the permanent magnets 60*a* and 60*b*. Here, reference numerals 62, 63, 64, 65, 66, and 67 indicate spacers.

Figure 14:
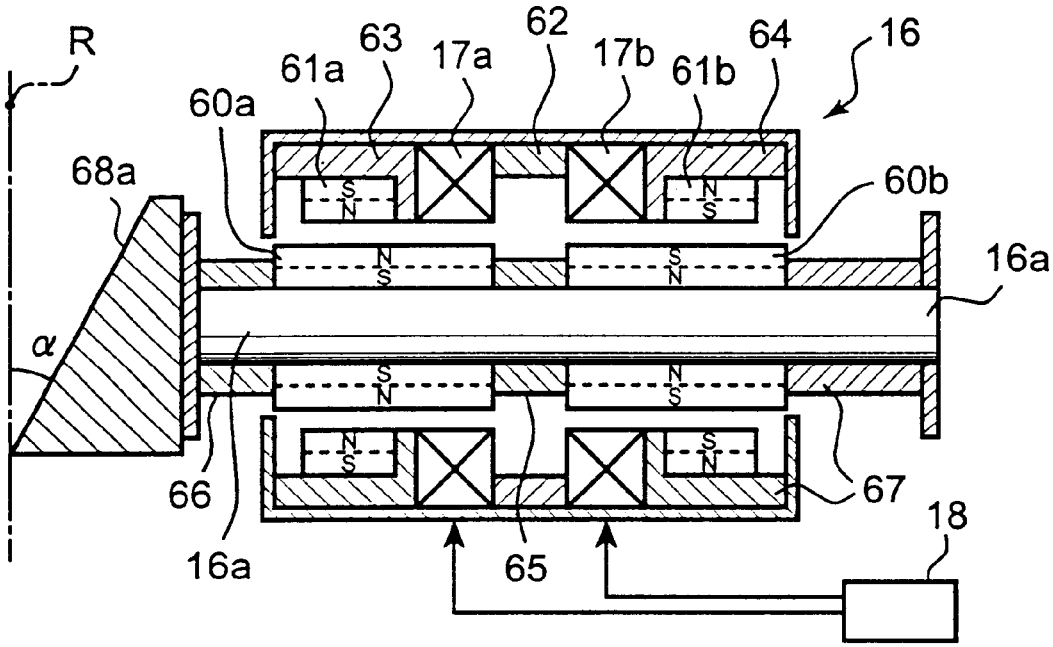
FIG. 14 is a diagram showing a modified slanted surface at the foremost end portion of the reciprocating rod.

At the foremost portion of the reciprocating rod 16*a*, there is provided an ejection plate 68 of a rectangular shape as seen in the direction from the grain falling locus R. This ejection plate 68 is slanted by a predetermined angle a with respect to the grain falling locus R. More specifically, the upstream portion of the ejection plate 68 with respect to the falling locus R (namely, the upper part of the ejection plate 68 in FIG. 2) is positioned toward the main body side of the ejection means 16 while the downstream portion of the same with respect to the falling locus R (namely, the lower part of the ejection plate 68 in FIG. 2) is positioned toward the front side where the reciprocating rod 16*a* projects out. The surface area of the contact surface (slanted surface) 68*a* of the ejection plate 68 is in the range of 60% to 80% of one granular object to be sorted. In this way, because it is possible that the ejection plate 68 hits or flicks out only the defective granular object to be ejected, the acceptable granular objects around such defective object are avoided from being ejected. The material of the ejection plate 68 may be rubber or such foaming material as urethane foam which functions to absorb the impact against the granular objects. However, it is necessary that the ejection plate 68 can apply a pressure on the falling granular objects to the extent that they are effectively ejected based on the retracting and projecting-out operation of the reciprocating rod 16*a*. The slanted surface 68*a* may well be formed by an ejection plate 68 which is arranged at the foremost end of the reciprocating rod 16*a*. Further, the slanted surface 68*a* may be made by simply forming the foremost end of the reciprocating rod 16*a* as a slanted shape (see FIG. 14).

Figure 12:
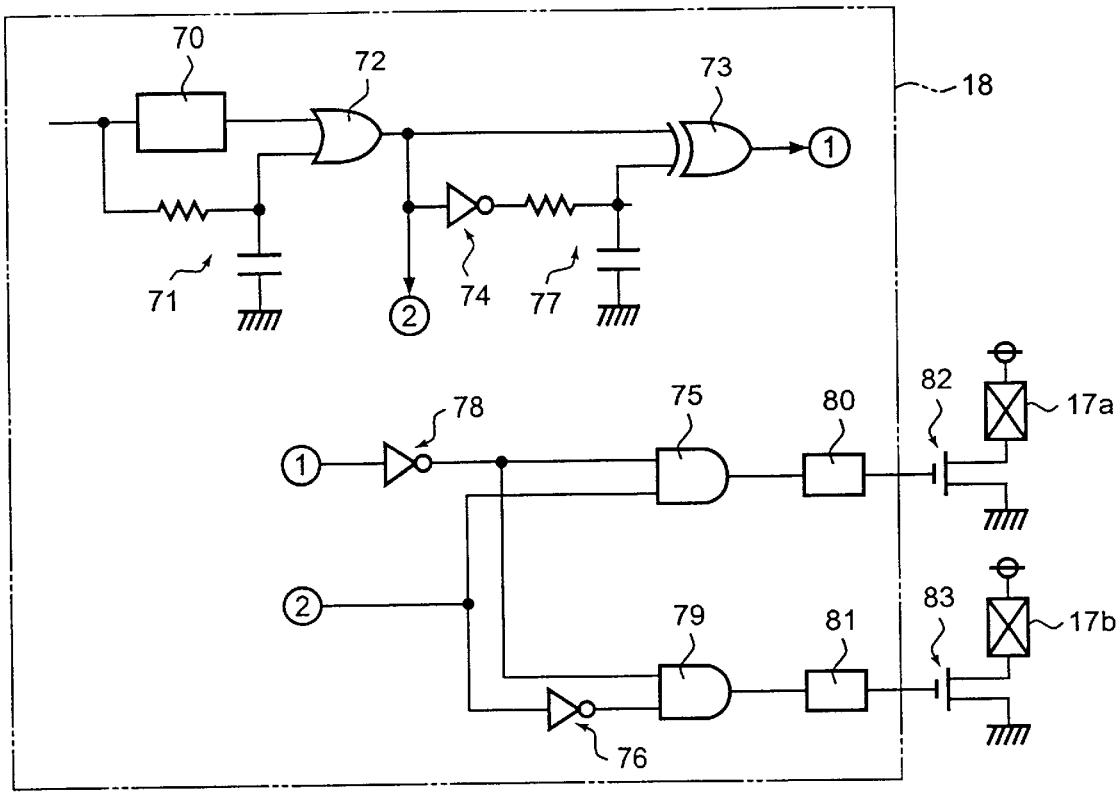
FIG. 12 is a diagram of a driver circuit.

Next, with reference to FIG. 2(*b*), FIG. 2(*c*) and FIG. 12, the structure of the driver circuit 18 for driving the ejection means 16, which is built-in in the control means 20 (explained later) and the operation of the ejection means 16 are explained. As shown in FIG. 12, the driver circuit 18 is constructed as follow. One-shot circuit (mono-stable multi-vibrator) 70 and a delay circuit 71 are connected to input terminals of an OR-gate 72, and the output terminal of the OR-gate 72 is connected to one input terminal of an EX-OR gate 73, an inverter 74, one input terminal of an AND-gate 75 and an inverter 76. The inverter 74 is connected to the other input of the EX-OR gate 73 through a delay circuit 77. The output of this EX-OR gate 73 is connected to the other input terminal of the AND-gate 75 and one input terminal of an AND-gate 79 through an inverter 78. The inverter 76 is connected to the other input terminal of the AND-gate 79. The AND-gate 75 is connected to a delay circuit 80, and the AND-gate 79 is connected to a delay circuit 81. Further, the delay circuit 80 is connected to an electronic switch (FET: field effect transistor) 82 of the ejection means 16, and the delay circuit 81 is connected to an electronic switch (FET: field effect transistor) 83 of the ejection means 16. The electronic switches 82 and 83 are connected to the electromagnetic coils 17*a* and 17*b*, respectively.

Figure 13:
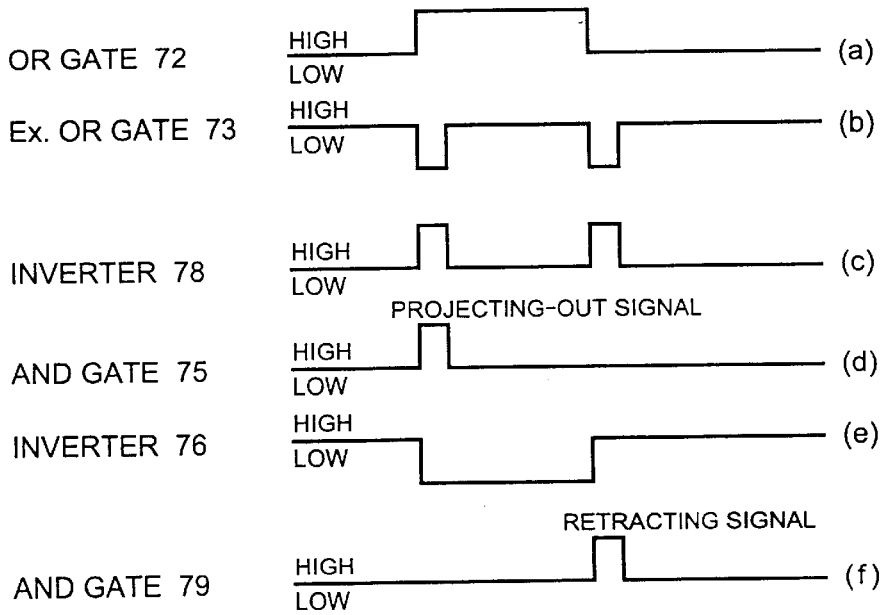
FIG. 13 is a time-chart of partial pulse signals in the driver circuit.

When an ejection signal is outputted to the driver circuit 18 constructed as above from the input and output circuit 33 explained later, the ejection signal is inputted to the one-shot circuit 70 and the delay circuit 71. The output signals from the one-shot circuit 70 and the delay circuit 71 are respectively inputted to the OR-gate 72, and the OR-gate 72 outputs a signal of HIGH level as shown in FIG. 13(*a*). This HIGH signal is forwarded to the EX-OR gate 73, inverter 74, AND-gate 75 and inverter 76. The HIGH signal is, after inverted to a signal of LOW, forwarded to the EX-OR gate 73 through the delay circuit 77. The EX-OR gate 73 receives at its input terminals the LOW signal from the delay circuit 77 and the HIGH signal from the OR-gate 72, and it outputs two LOW signals as shown in FIG. 13(*b*). These two LOW signals are inverted to HIGH signals by the inverter 78, and the inverted HIGH signals are forwarded to the AND-gate 75 and the AND-gate 79. The AND-gate 75 receiving at its input terminals the signals from the OR-gate 72 and the inverter 78 outputs a HIGH signal (projecting-out signal) as shown in FIG. 13(*d*). The inverter 76 inverts the signal from the OR-gate 72 and forwards the inverted signal as shown in FIG. 13(*e*) to the AND-gate 79. The AND-gate 79, which receives at its input terminals the signals from the inverter 78 and the inverter 76, outputs HIGH signal (retracting signal) as shown in FIG. 13(*f*).

The HIGH signal (projecting-out signal) outputted from the AND circuit 75 is forwarded to the delay circuit 80. In the delay circuit 80, a predetermined delay time, with the distance between the light receiving section and the reciprocating rod 16*a* and other conditions being taken into consideration, is set in advance so that the ejection plate 68, when the reciprocating rod 16*a* projects out, hits the center of the defective granular objects. The method for detecting the center of the defective object is explained later. The delay circuit 80 outputs the HIGH signal (projecting-out signal) to the electronic switch 82 after the lapse of the above delay time. This HIGH signal (projecting-out signal) turns on the electronic switch 82 so that the current flows in the electromagnetic coil 17*a*. This current causes the electromagnetic coil 17*a* to produce the magnetic poles whose polarities are as shown in FIG. 2(*b*). Based on the attracting and repelling action between the magnetic poles of the electromagnetic coil 17*a* and the permanent magnets 60*a*, 60*b* on the reciprocating rod 16*a*, the reciprocating rod 16*a* projects out.

As shown in FIG. 13(*f*), the HIGH signal (retracting signal) from the AND-gate 79 which is delayed with a certain delay time from the HIGH signal (project-out signal) from the AND-gate 75 is forwarded to the delay circuit 81, and this delay circuit 81 forwards a HIGH signal to the electronic switch 83 after the lapse of the same delay time which has been set to the delay circuit 80. In response to this HIGH signal (retracting signal), the electronic switch 81 turns ON (conductive state) whereby there flows a current in the electromagnetic coil 17*b*. Based on this current, there are produced magnetic poles as shown in FIG. 2(*c*) in the electromagnetic coil 17*b* and, thus, the reciprocating rod 16*a* retracts by the attracting/repelling action between the above magnetic poles and the permanent magnets 60*a*, 60*b* on the reciprocating rod 16*a*. In this way, the reciprocating rod 16*a* projects out and retracts according to the ON/OFF control of the respective electromagnetic coils 17*a* and 17*b* based on the projecting-out and retracting signals.

Next, the driving signals (projecting-out and retracting signals) under the state wherein the granular objects to be ejected by a given ejection means 16 flows-in continuously are explained. While the one-shot circuit 70 is outputting one pulse signal corresponding to one defective grain, if the next ejection signal enters into such oneshot circuit 70, the one-shot circuit 70 continues from this moment to output the pulse corresponding to one grain. Thus, the signal to be outputted from the OR gate 72 becomes a comparatively long duration signal corresponding to the two grains so that the retracting signal is outputted at a timing corresponding to an end of the second defective grain. In this way, as to the two defective granular objects which flowed-in continuously, the first granular object is ejected by the slanted surface 68*a* of the reciprocating rod 16*a* which projects out to meet the first granular object, and the second granular object following the first granular object is ejected by being hit by the slanted surface 68*a* of the reciprocating rod 16*a* which is under the projected out state. The reciprocating rod 16*a* retracts after the ejection of the second granular object. Even when three or four granular objects are to be ejected, they can be ejected similarly by one set of projecting-out and retracting actions of the reciprocating rod.

Since the reciprocating rod 16*a* is borne in a non-sliding state, the ejection means 16 never suffers from friction with any other parts in retracting and projecting-out operations of the reciprocating rod thus ensuring the excellent response performance. According to the test results, operating time of the reciprocating rod 16*a* is between 0.6 ms and 0.9 ms, which is equivalent to or slightly better than the operating time in an air type ejector. Thus, even by dispensing with the air source, it is possible to realize the ejector having a better response performance.

Figure 3:
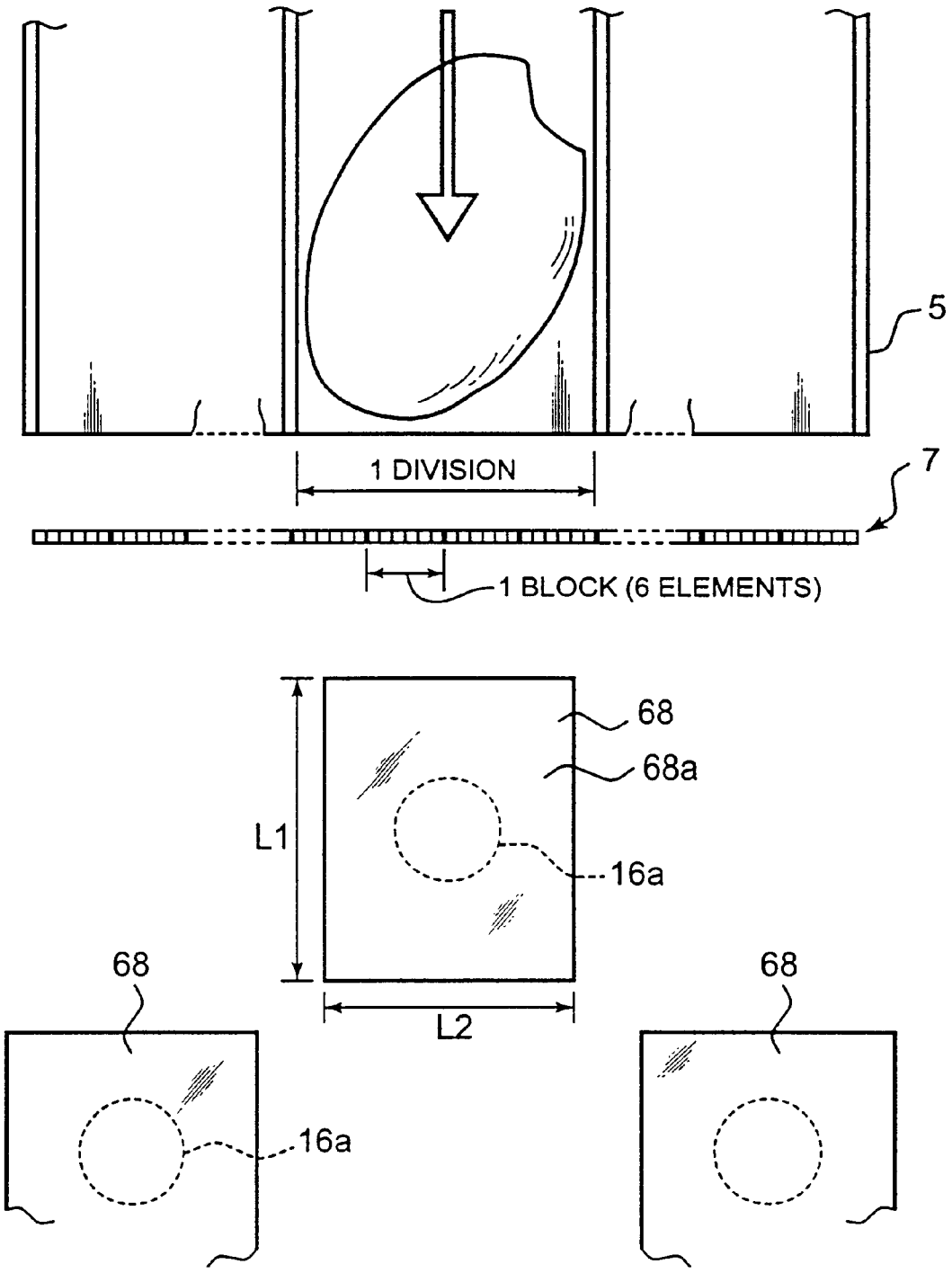
FIG. 3 is a diagram showing the relationship between the chutes and the sensor elements.

FIG. 3 is a diagrammatic enlarged view, seen from the front side of the chute 5, showing the arrangement, in the width direction of the grain flowing on the chute 5, of the chute 5, the light receiving section 7, the reciprocating rod 16*a* and the ejection plate 68. For simplifying the explanation, the chute 5 is shown as being divided in a given width into a plurality of sections, and the reciprocating rod 16*a* is assigned to each section of the chute 5. This may well be arranged by a flat plate without divisions by utilizing a commonly known technique. In the case where the object is a rice grain, if the length of the grain is assumed to be 5 mm, the length L1 of the ejection plate 68 is preferably in the order of 4 mm. The transverse length L2 of the ejection plate 68 is preferably in the order of 3 mm. In the illustrated example, one block of the light receiving section 7 is constituted by six (6) light receiving sensor elements, and one (1) reciprocating rod 16*a* is assigned to four (4) such blocks. That is, the illustrated example relates to the arrangement wherein, by 24 elements, the amount of ray from the rice grain that flows on one section of the chute 5 is received. In other words, for each reciprocating rod 16*a*, there are twenty four (24) image elements in a transverse direction. When the rice grains are image taken, the rice grains are scanned in a direction perpendicular to the flow of the rice grains.

Figure 4:
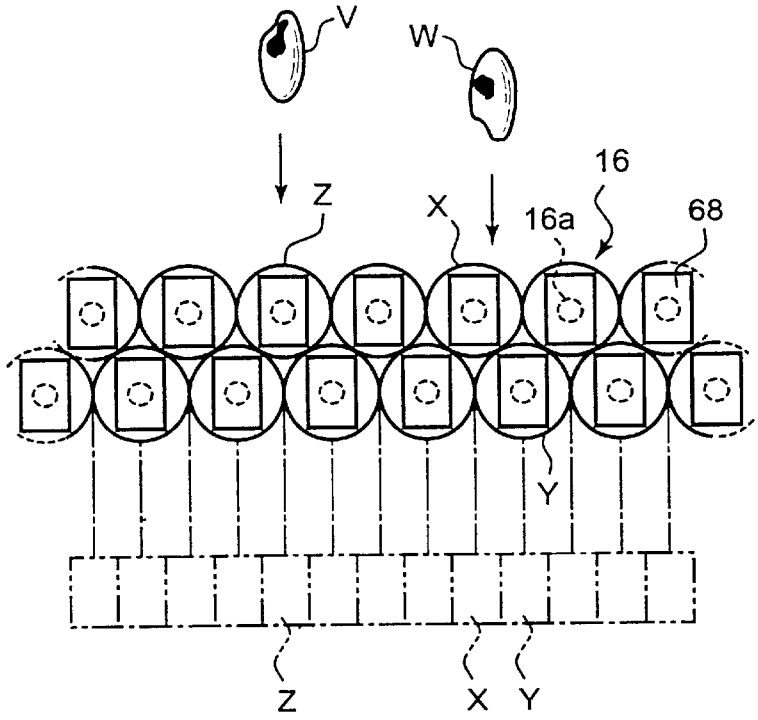
FIG. 4 is a diagram showing the ejection means arranged in a zigzag or staggered form.
Figure 5:
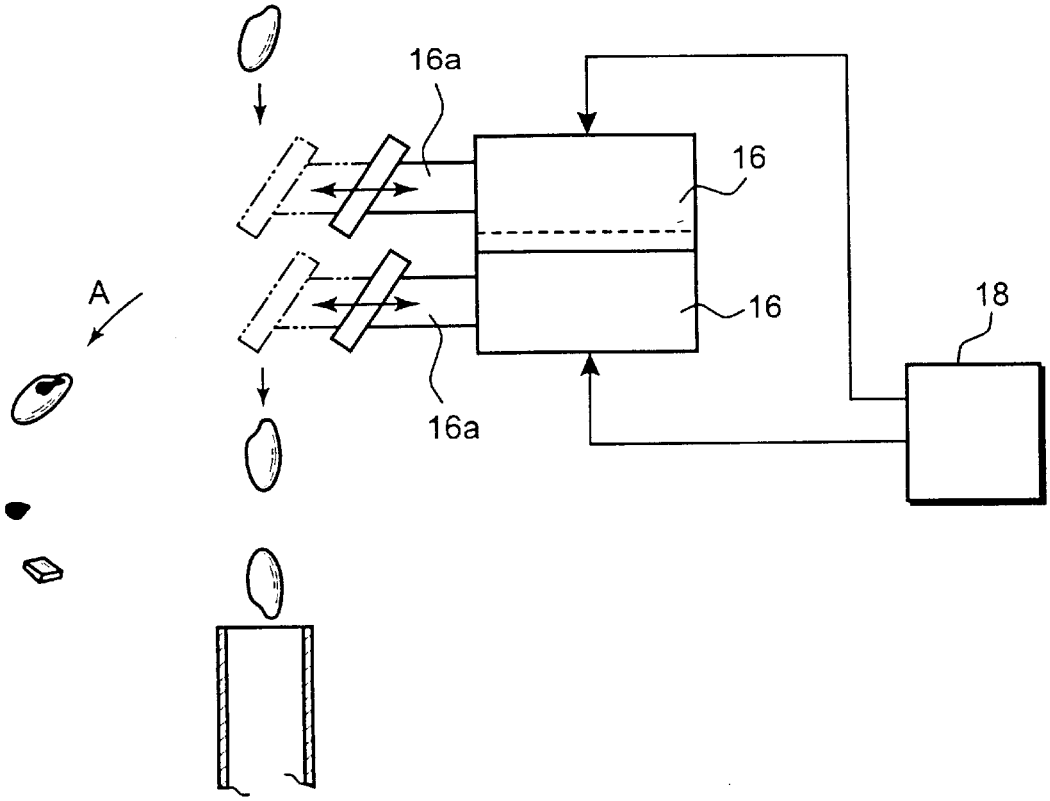
FIG. 5 is a rear view of the ejection means arranged in a zigzag or staggered form.

Here, some additional explanation is made with reference to FIGS. 4 and 5 based on the arrangement of the ejection means 16 shown in FIG. 1. It is preferred that the ejection plate 68 provided at the foremost end portion of the reciprocating rod 16*a* be arranged such that the ejection plates are positioned continuously without leaving gaps in the width direction of the flow of the grains. As arranged in up and down rows in FIG. 1, the ejection means 16, depending on their sizes (outside diameters), may desirably be placed in a zigzag or staggered form as shown in FIG. 4(*a*). FIG. 4(*a*) shows the same view as seen from the same direction as in FIG. 3. In this way, the ejection plate 68 can ideally be arranged as;in FIG. 4(*b*) without leaving gaps.

A further explanation is made as additional explanation to that made with reference to FIG. 3. When a grain falls down at the location of the symbol V, the reciprocating rod at the symbol Z is caused to be operated. When a grain falls down at the location of the symbol W, both the reciprocating rods at the symbols X and Y may be caused to be operated. This judgment is made by the control unit 20 which is explained later.

When these arrangements are seen from the side as in FIG. 1, the individual ejection means 16 in the upper row and the lower row are deviated one another in a vertical direction as shown in FIG. 5. The driving signals outputted from the driver circuit 18 are arranged such that the output timing of the projecting-out/retracting signals to the upper row ejection means 16 and the output timing of the projecting-out/retracting signals to the lower row ejection means 16 are different from each other. That is, with the deviation in the locations of the upper row ejection means and of the lower row ejection means taken into account, the delay time is set in each of the delay circuits 80, 81. In this way, the timing is matched to the timing in which the grain falls from above and the defective/foreign grain is ejected by the projecting-out/retracting actions of the reciprocating rod 16*a* while, for the acceptable grain, the reciprocating rod 16*a* remains inactive to allow such grain to pass. In this case, as already explained, since the ejection plate 68 is slanted by a predetermined angle a with respect the falling locus R, any defective/foreign grain hit by the ejection plate 68 is, even when such grain is oriented in a direction different from that of any preceding or following defective/foreign grain, flicked out stably in an obliquely downward direction (shown by an arrow A in FIG. 5) from the falling locus R.

Figure 6:
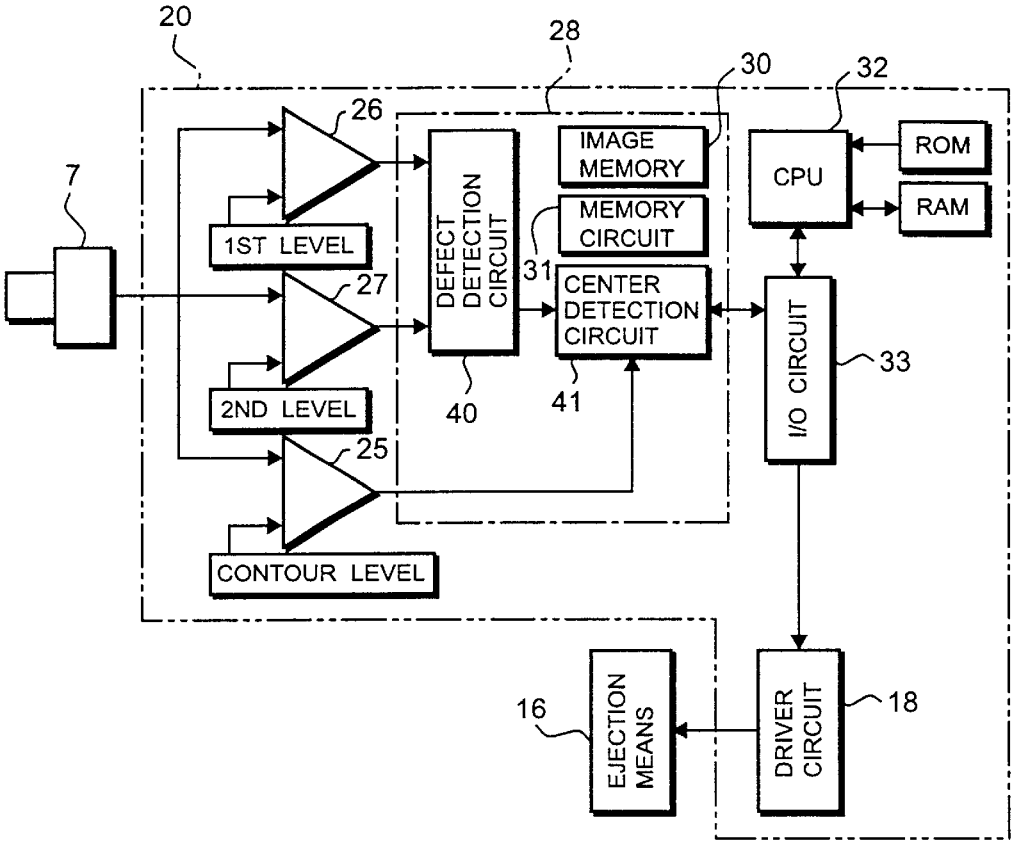
FIG. 6 is a block diagram showing the processing of signals from a CCD sensor among control means of the granular object sorting apparatus.
Figure 7:
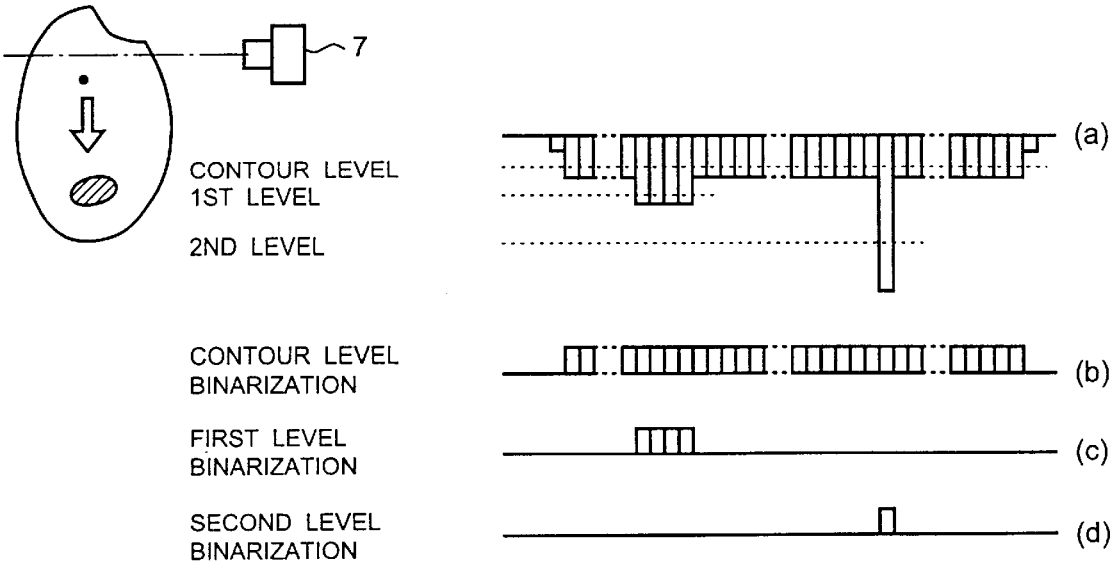
FIG. 7 is a diagram showing the signals received by the CCD sensor and their binarized signals.

Next, with reference to FIGS. 6 and 7, the control unit 20 which processes the signals outputted from the light receiving sections 7, 8 is explained. The control unit 20 is equipped with a comparator 25 having a threshold value corresponding to a contour level; a comparator 26 having a threshold value corresponding to a comparatively light or thin color (first level); a comparator 27 having a threshold value corresponding to a comparatively heavy or thick color (second level); an image processing board 28 which image-processes signals from each of the comparators; and the already mentioned driver circuit 18 which receives sorting signals (defective object signals) outputted based on the output signals from the image processing board 28. For other components, such as an image memory 30 and a memory circuit 31 storing the processing program, which are of common design matters, no details thereof have been illustrated. Also, since the CPU 32 as the arithmetic and control unit and the input/output (I/O) circuit 33 for such CPU can be designed in various ways, such as for controlling processing steps individually or for controlling such steps in a batch way by one CPU, only one example has been explained in detail and no details have been illustrated.

The control unit 20 receives a plurality of image signals outputted from the CCD sensors at the light receiving section 7. The image signals are inputted to the comparators 25, 26, 27 and are binarized by the respective threshold values. Of the binarized signals, the signals from the comparators 26, 27 are subjected to the defective detection process by the defective detection circuit 40 in the image processing board 28 for confirming the presence or non-presence of any defective object signal. When the presence of a defective object signal is detected, the central detection process is conducted in the center detection circuit 41. With the illustration of intermediate details being omitted, FIG. 7(*a*) shows an example of a digital signal which is outputted from the CCD sensor for one rice grain. This example shows a case where, in one rice grain, there exist a comparatively light color portion of a large size and a comparatively heavy color portion of a small size. FIG. 7(*a*) shows an example in which the threshold value levels of three different comparators are shown together. When, the signals as in FIG. 7(*a*) are inputted into each of the comparators 25, 26, 27, the signals outputted from the comparators 25, 26, 27 are respectively binarized signals as exemplified in FIGS. 7(*b*), 7(*c*) and 7(*d*). These binarized signals are stored consecutively in the image memory 30 of the image processing board 28. Although the comparators 25, 26, 27 have been shown as separate circuits, it may be programmed so that the similar processes may be carried out at the image processing board 28.

Figure 8:
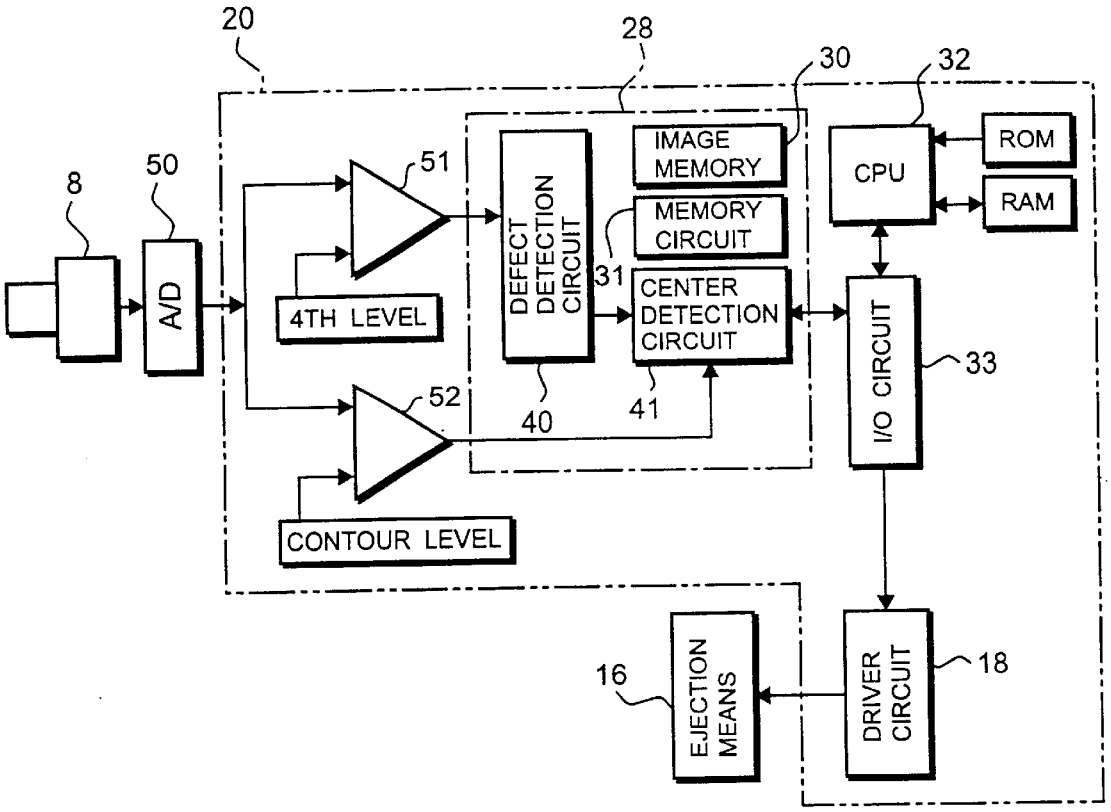
FIG. 8 is a block diagram showing the processing of signals from an InGaAs sensor among control means of the granular object sorting apparatus.

When the output is an analog signal as in a general InGaAs sensor, if an analog/digital converting circuit 50 is provided as shown in FIG. 8, the signal processing can be conducted as when the control unit 20 is used. However, in this case, the comparator 51 used is one in which the threshold value is set to the fourth value for sorting out foreign objects (e.g., glass, resin and pebbles). Also, for detecting a contour level of the foreign objects, the comparator 52 in which a threshold value for this purpose is set in advance is used, and the binarized signal may be used as a signal for specifying the contour of the object in a manner similar to the above.

Figure 11:
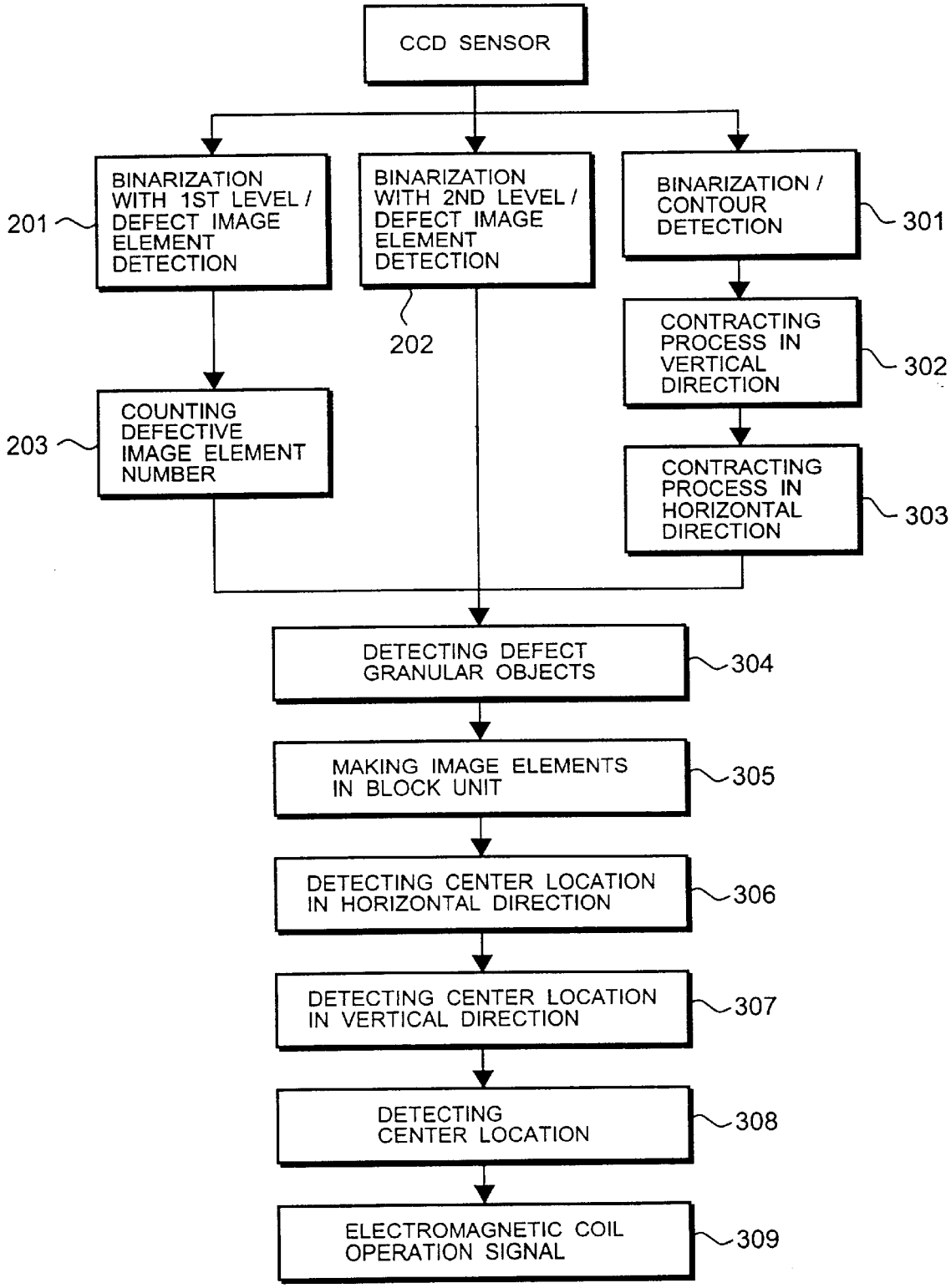
FIG. 11 is a flow-chart of image processing.

Hereunder, the image processing is explained with reference to FIG. 9 through FIG. 11. As to the data outputted from the CCD sensor 7, for example, 12 bits outputted in parallel, they may be rearranged to serial data and converted to 8 bits. The data from the CCD sensor 7 thus converted are binarized by the threshold values (first level and second level) of the colored portion set in advance in the comparators 26, 27 and the contour threshold value (Steps 201, 202, 301). FIG.

9(*a*) shows an example of a part of the data obtained by multi-scanning and binarized by the first level. Similarly the data binarized by the second level can be obtained.

Next, the signal processing at the image processing board 28 is explained. This processing is carried out by the program stored in advance in the memory circuit 31 of the image processing board 28. The conditions under which the rice grain is determined as defective are set as hereunder at the initial setting in the image processing of the data binarized by the comparator 26 having the first level. That is, the number of contiguous image elements (horizontally) in the scanning direction is set to 3, and the number of contiguous image elements (vertically) in the flow direction is set to 2. When applied to the grain in FIG. 9(*a*), the number of contiguous image elements is 4 in the m'th scanning, 7 in the (m+1)'th scanning, and 5 in the (m+2)'th scanning, so that, in either of these three scannings, the number of contiguous image elements as 3 in the horizontal direction set in the initial setting is exceeded thus indicating the defective grain. Also, the number of contiguous image elements as 2 in the vertical direction set in the initial setting is exceeded so that the detected collective image elements are judged as indicating the defective grain (Step 203). Further, in the example of FIG. 9(*b*), the number of contiguous image elements in the n'th scanning in the horizontal direction set in the initial setting is 3 and does not exceed the number of contiguous image elements of 3 in the horizontal direction set in the initial setting. In this case, no contiguous image elements are present in the vertical direction so that the aggregate of the image elements is not judged as those of defective grain and is canceled. The defective grain image elements detected in the data binarized by the comparator 27 of the second level are immediately or straightly judged as defective since the threshold value is different from that of the first level and the image elements are of more heavily colored.

Simultaneously with the processing of the binarized data of the colored portion, the contour level processing of the rice grain is carried out as shown in FIG. 10(*a*) and FIG. 10(*b*). FIG. 10(*a*) shows the signal which is obtained by the comparator 25 with the contour level being set. That is, the signal is one in which a simple binarizing process is performed on the contour signal of the rice grain (Step 301). Following this, the contracting process of the contour is carried out. For the contracting process, as shown in FIG. 10(*b*), the surrounding or peripheral image elements in the vertical direction are evenly canceled one element by one element (Step 302). Next, as shown in FIG. 10(*c*), the surrounding or peripheral image elements in the horizontal direction are evenly canceled three elements by three elements (Step 303). The number of the image elements canceled may be set arbitrarily, and there is no need to use the values used here. By this process, it is possible to make clear the contour of one rice grain by separating this from other grain images.

Figure 9A:
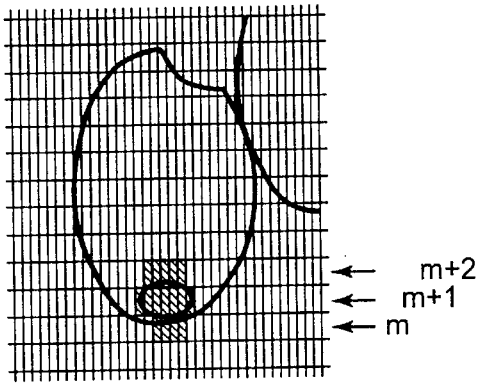
FIG. 9 is a diagram showing images of colored portions detected by image processing.
Figure 9B:
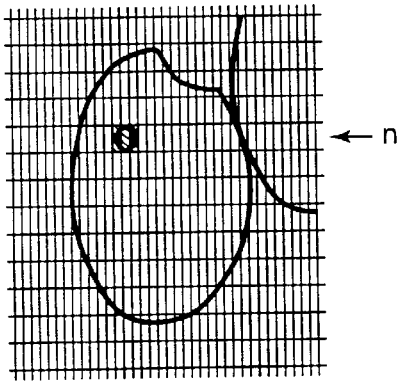
Figure 10A:
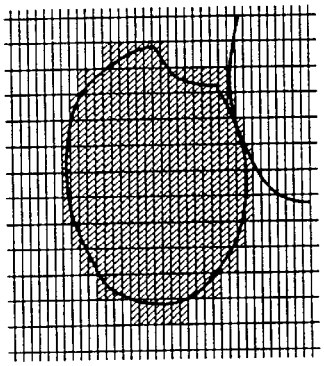
FIG. 10 is a diagram showing images of contour of a rice grain detected by image processing.
Figure 10B:
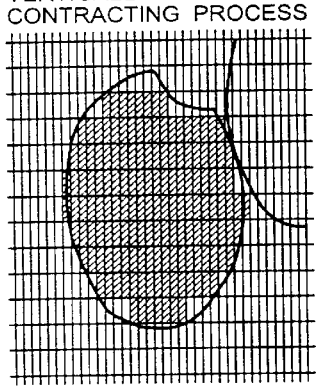
Figure 10C:
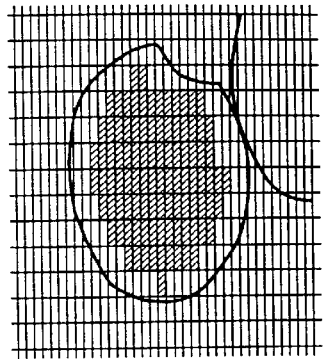
Figure 10D:
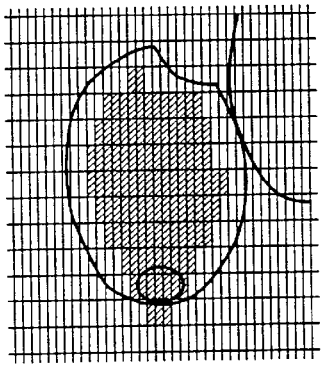
Figure 10E:
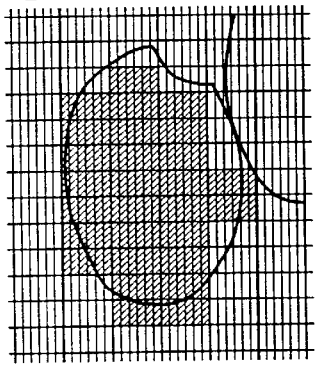
Figure 10F:
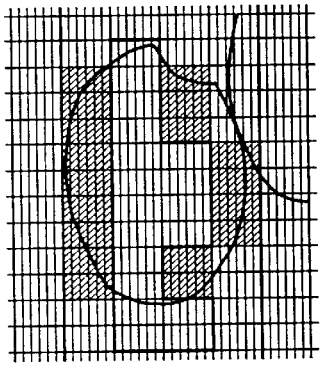
Figure 10G:
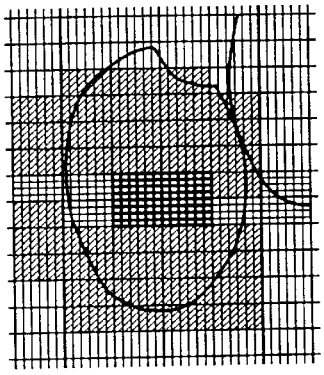
Figure 10H:
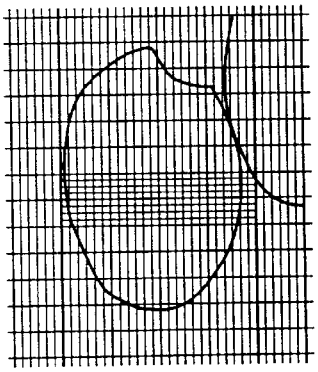

The image element (FIG. 9(*a*)) detected based on the colored portion in the steps 201, 203 and the contour image element (FIG. 10(*c*)) of the rice grain obtained up to the step 303 are superimposed as shown in FIG. 10(*d*), and the contour of the overall colored grain is made clear (Step 304).

Next, similarly as shown in FIG. 3 in which, along the transverse width of the reciprocating rod 16*a*, the plurality of sensor elements of the light receiving section 7 are divided in such a manner that six (6) sensor elements are made one (1) block and then four (4) blocks are made one (1) division, in the image processing, jointly with the reciprocating rod 16*a*, six (6) image elements are made one (1) block and then overall structure is converted to a block unit. Then, even if one defective grain exists within the six (6) image elements in the one (1) block, the overall block concerned is processed by enlarging process as defective grain block (Step 305, FIG. 10(*e*)).

The detection of the central location of the object is made as explained hereunder. The detection of the central location in the horizontal direction is made, based on the data of FIG. 10(*e*), by conducting OR operation of each block data with the upper and lower row block data thus enlarging the data, and by the pattern matching of the enlarged data. When there are even numbers of data in the horizontal direction, two (2) blocks in the center are made the center and, when there are odd numbers of data, one (1) block in the center is made the center (Step 306, FIG. 10(*f*)). The detection of the central location in the vertical direction is made, based on the data of FIG. 10(*e*), by conducting OR operation of each block data with the right and left block data thus enlarging the data, and by the pattern matching of the enlarged data. When, in the vertical direction, there are even numbers of data, two (2) blocks in the center are made the center and, when there are odd numbers of data, one (1) block in the center is made the center (Step 307, FIG. 10(*g*)). The center locations thus obtained in the horizontal direction and vertical direction are subjected to AND operation, and the four (4) blocks (lattice pattern blocks) in the center as shown in FIG. 10(*g*) are obtained (Step 308). Once the blocks in the central location are obtained, the division in which these blocks exist is determined (FIG. 10(*h*)), and the ejection means 16 which corresponds to that division is determined. The ejection signal is outputted to the driver circuit 18 to which the ejection means 16 is connected (Step 309).

Signals are outputted in such a way that the reciprocating rods 16*a* corresponding to the divisions in which the blocks in the center obtained as above exist retract and project out so that, as in FIG. 10(*g*), when the center blocks are present in one division, this division is decided. However, when the center blocks bridge over the two (2) divisions in the horizontal direction, the two (2) reciprocating rods 16*a* corresponding to the two (2) divisions retract and project out.

In the above, mainly the processing of the signal from the CCD sensor received at the light receiving section 7 has been explained. The processing of the signal from the InGaAs received at the light receiving section 8 can be similarly conducted if the sensor is one from which an appropriate resolution is obtainable. For the detection of a foreign object, the existence of the foreign object is confirmed through the binarization by the comparator 51 in which the fourth contour level is set, and the contour is confirmed through the binarization by the comparator 52 in which the contour level is set. Also, depending on the kinds of foreign objects, the data binarized by the fourth level comparator 51 can be used as it is as the contour data. This is when there are no plurality of light and heavy levels in the colored portions as in the colored portions detected by the CCD sensor.

As above, the resolution of the sensor has been raised thus enabling the detection of colored portions of various sizes, and enabling the sizes of the colored portions by specifying the number of image elements. Thus, by raising the resolution, it is made possible not only to enhance the detection precision for lightly colored defective portions but also to enable the determination of the sizes by counting the image elements. Thus, by the raising of the resolution, advantageous effects are produced.

By detecting the contour of the granular objet and by superimposing the image elements of defective portions to the aggregate of the image elements which become the contour of the granular object, the granular objects in which the defective image elements exist are recognized as defective granular objects, and the image element in the central location is specified irrespective of the location of the image element at the defective portion in the aggregation of the image elements of the defective granular objects. In this way, unlike in the conventional sorting wherein the sorting action depended on the image elements of the defective portion, the sorting signals to act on the central location of the defective granular object corresponding to the central location of the specified defective granular object are outputted, and the sorting action can be given to the central location of the defective granular object irrespective of the location of the defective portion, and it is ensured that only one defective granular object is ejected no matter where in the granular object the defective portion of the defective granular objects exists.

The ejection means which effects the ejection of the falling granular objects by the reciprocating rod is configured such that the reciprocating rod is in a non-sliding state so that there is no possibility for the reciprocating rod to be subjected to any load caused by sliding friction in the reciprocating rod during the retracting or projecting-out operation thereof. The arrangement can achieve the response performance as good as the conventional air type ejector, thus enabling the maintenance of the same productivity as before and also enabling, with the dispensing of any air source, the provision of an energy-saving granular object sorting apparatus. Further, at the foremost end portion of the reciprocating rod, there is provided a slanted surface inclining towards the projecting-out direction of the reciprocating rod from the upstream side of the falling locus, with the slanted surface hitting the granular object in the falling locus during the projecting-out operation of the reciprocating rod, and it is arranged that the driver circuit outputs a driving signal to the reciprocating means so that, when the granular objects to be ejected by a given ejection means are determined as contiguous, the retracting or projecting-out operation of the reciprocating rod is caused correspondingly to the leading granular object to be ejected and, after the ejection of the succeeding granular object(s) to be ejected, the retracting operation takes place. Thus, the leading granular object is ejected by the slanted surface of the reciprocating rod which projects out correspondingly to the leading granular object, and the second granular object succeeding to the leading granular object is ejected by being hit by the slanted surface of the reciprocating rod held in the projected-out state. The reciprocating rod performs the retracting operation after the ejection of the second granular object. Thus, even when the granular objects to be ejected by a given ejection means flow-in continuously, these granular objects are ejected so that the grain sorting precision is improved and enhanced.

While the invention has been described in its preferred embodiments, it is to be understood that the words which have been used are words of description rather than limitation and that changes within the purview of the appended claims may be made without departing from the true scope of the invention as defined by the claims.

What is claimed is:

1. A granular object sorting apparatus comprising:

a transfer means for transferring granular objects to be sorted;

an illuminating means for irradiating light to said granular objects released from said transfer means;

a light receiving means for receiving light from the granular objects having received irradiating light of said illuminating means, said transfer means, said illuminating means and said light receiving means being arranged at a point along a falling locus of the granular objects released from said transfer means;

a determination means for determining as to whether each of the granular objects is to be ejected or not based on a received light signal from said light receiving means, and outputting an ejection signal for the object to be ejected;

a driver circuit for outputting a driving signal based on said ejection signal from said determination means; and an ejection means for ejecting the granular objects to be ejected, said ejection means including a reciprocating rod which is borne in a substantially frictionless state and which linearly projects out or retracts in an axial direction and a reciprocating means for causing the reciprocating rod to retract or project out by said driving signal from said driver circuit, said reciprocating rod having at a foremost end portion thereof a slanted surface inclining towards a projecting direction of the reciprocating rod from an upstream side of the falling locus, said slanted surface being adapted to hit the granular objects in the falling locus during a projecting-out operation of the reciprocating rod and said driver circuit being arranged to output the driving signal to the reciprocating means so that, when the granular objects to be ejected by a given ejection means are determined as contiguous, the projecting-out operation of the reciprocating rod is caused correspondingly to a leading granular object to be ejected and, after an ejection of a succeeding granular object or objects to be ejected, a retracting operation takes place.

2. A sorting apparatus according to claim 1, in which said ejection means is configured such that said reciprocating rod is borne in the substantially frictionless state by permanent magnets provided on said reciprocating rod and permanent magnets surrounding said reciprocating rod, said reciprocating rod being enabled to project out and retract by switching ON/OFF of the reciprocating means constituted by the permanent magnets provided on said reciprocating rod and electromagnetic coils surrounding said reciprocating rod.

3. A sorting apparatus according to claim 1, in which a plurality of said ejection means are provided in a zigzag or staggered form in a width direction of a flow of the granular objects.

4. A sorting apparatus according to claim 1, in which said slanted surface of the ejection means has a surface area in a range between 60% and 80% of one granular object to be sorted.

5. A sorting apparatus according to claim 1, in which a shape of said slanted surface seen from a front side is rectangular.

* * * * *

UNITED STATES PATENT AND TRADEMARK OFFICE

CERTIFICATE OF CORRECTION

PATENT NO. : 6,629,611 B2
DATED : October 7, 2003
INVENTOR(S) : Satoru Satake et al.

It is certified that error appears in the above-identified patent and that said Letters Patent is hereby corrected as shown below:

Column 9,
Line 31, replace "arranged as;in FIG. 4(*b*) without leaving gaps." with -- arranged as in FIB. 4(*b*) without leaving gaps. --
Line 59, replace "a predetermined angle a with respect the falling locus R, any" with -- a predetermined angle α with respect the falling locus R, any --

Signed and Sealed this

Fifteenth Day of February, 2005

JON W. DUDAS
*Director of the United States Patent and Trademark Office*